US006119974A

United States Patent [19]

Wente et al.

[11] Patent Number: 6,119,974

[45] Date of Patent: Sep. 19, 2000

[54] EXPANDABLE MANDREL CORE

[75] Inventors: Thomas J. Wente, New Bremen; Andrew J. Prenger, Troy, both of Ohio

[73] Assignee: Precision Strip, Inc., Minster, Ohio

[21] Appl. No.: 09/133,313

[22] Filed: Aug. 12, 1998

[51] Int. Cl.[7] ..... B65H 18/08; B65H 75/24

[52] U.S. Cl. ..... 242/530.1; 242/520; 242/571

[58] Field of Search ..... 242/571, 530.1, 242/575, 573.9, 407.1, 613, 613.1, 613.2, 118.3, 520

[56] References Cited

U.S. PATENT DOCUMENTS

| | | | |
|---|---|---|---|
| 1,328,408 | 1/1920 | Walker . | |
| 3,396,918 | 8/1968 | Adamson et al. | 242/571 |
| 3,406,924 | 10/1968 | Bruns et al. | 242/56.4 |
| 3,878,999 | 4/1975 | Daves | 242/56.9 |
| 4,093,140 | 6/1978 | Matsunaga | 242/56.2 |
| 4,201,352 | 5/1980 | Madachy | 242/56.2 |
| 5,480,106 | 1/1996 | Voissem | 242/571 |
| 5,520,353 | 5/1996 | Brandstetter et al. | 242/530.3 |
| 5,904,315 | 5/1999 | McInerney | 242/571 |

*Primary Examiner*—John Q. Nguyen
*Attorney, Agent, or Firm*—Wood, Herron & Evans, LLP

[57] ABSTRACT

An expandable annular core is provided for mounting on a conventional expandable mandrel of a coil slitting machine to achieve a greater inner diameter for the coil wound thereon. The inner diameter of the annular core is approximately equal to the outer diameter of the expandable mandrel, and the outer diameter of the core is equal to the desired inner diameter of the coils. A plurality of cores are placed in series on the mandrel, each core being adapted to receive a strand of slit metal on it's outer surface. The cores are capable of expanding and contracting with the mandrel to facilitate removal of the coils from the recoiler. To effect this expansion and contraction, the annular core has a radial slot or joint, preferably with opposing ends of at tongue and groove-shaped configuration.

9 Claims, 2 Drawing Sheets

EXPANDABLE MANDREL CORE

FIELD OF THE INVENTION

This invention relates generally to rewinding slit metal into coils, and more specifically to an expandable core for increasing the inner diameter of the coil.

BACKGROUND OF THE INVENTION

Sheet metal manufacturers typically produce sheets of metal material in coiled form having a substantial width. Before such coiled metal can be used for certain fabrication purposes, it must be cut by a slitter into strips or strands of desired width and recoiled for shipping and handling. The typical slitting apparatus has an uncoiler, a slitter and a recoiler. The coiled sheet is uncoiled and passed through the slitter to form a plurality of individual strands. These individual strands are then wound onto a mandrel or drum on the recoiler to form a plurality of individual coils. U.S. Pat. Nos. 3,406,924 and 4,093,140, the entire disclosures of which are each hereby incorporated by reference, disclose a recoiler in the slitting apparatus that utilizes a diametrically expandable mandrel for winding the coils thereon. The mandrel retracts or collapses so that the coils can be easily removed therefrom. These mandrels also commonly employ a clamping slot or other gripping means to secure the leading ends of the strips. U.S. Pat. No. 3,406,924 also discloses the use of cylindrical cores placed on the mandrel that are frictionally driven by the mandrel and provide relative rotation or slip as required to maintain a tension in each of the individual strips according the varying thicknesses among the strips.

The conventional mandrels used in slitting machines are available with standard outer diameters, such as 6 inches or 24 inches in the expanded position. The recoiled strips will have an inner diameter equal to the outer diameter of the expanded mandrel. If coils with an inner diameter other than a standard dimension are desired by a customer for a particular application, a mandrel of the desired nonstandard diameter must be mounted on the sheet metal slitting apparatus. Mandrels, particularly expandable mandrels, are complex and costly to manufacture, and in addition, mandrels of nonstandard diameters require new forgings and patterns. If the quantity of slit metal for a particular customer application does not justify the cost of manufacturing a new, special mandrel, the sheet metal slitter may be unable to satisfy the customer's request.

There is thus a need to develop an inexpensive means for a sheet metal slitter to adjust the size of the inner diameter of the coils.

SUMMARY OF THE INVENTION

The present invention provides an inexpensive, expandable annular core for mounting on a conventional expandable mandrel of a coil slitting machine to achieve a greater inner diameter for the coil wound thereon. To this end, the inner diameter of the annular core is approximately equal to the outer diameter of the expandable mandrel, and the outer diameter of the core is equal to the desired inner diameter of the coils. In a further feature of the present invention, a plurality of cores are placed in series on the mandrel, each core being adapted to receive a strand of slit metal on it's outer surface. The cores are capable of expanding and contracting with the mandrel to facilitate removal of the coils from the recoiler. In a still further feature of the present invention, the annular core has a radial expansion slot or joint that permits the expansion and contraction. The radial expansion joint preferably has one end of a tongue configuration opposing and slidably interconnected with a second end of a groove configuration end to form blind axial gaps upon expansion of the core.

These and other objects and advantages of the present invention shall become more apparent from the accompanying drawings and description thereof.

BRIEF DESCRIPTION OF THE INVENTION

The accompanying drawings, which are incorporated in and constitute a part of this specification, illustrate embodiments of the invention and, together with a general description of the invention given above, and the detailed description given below, serve to explain the principles of the invention.

Figure 4:
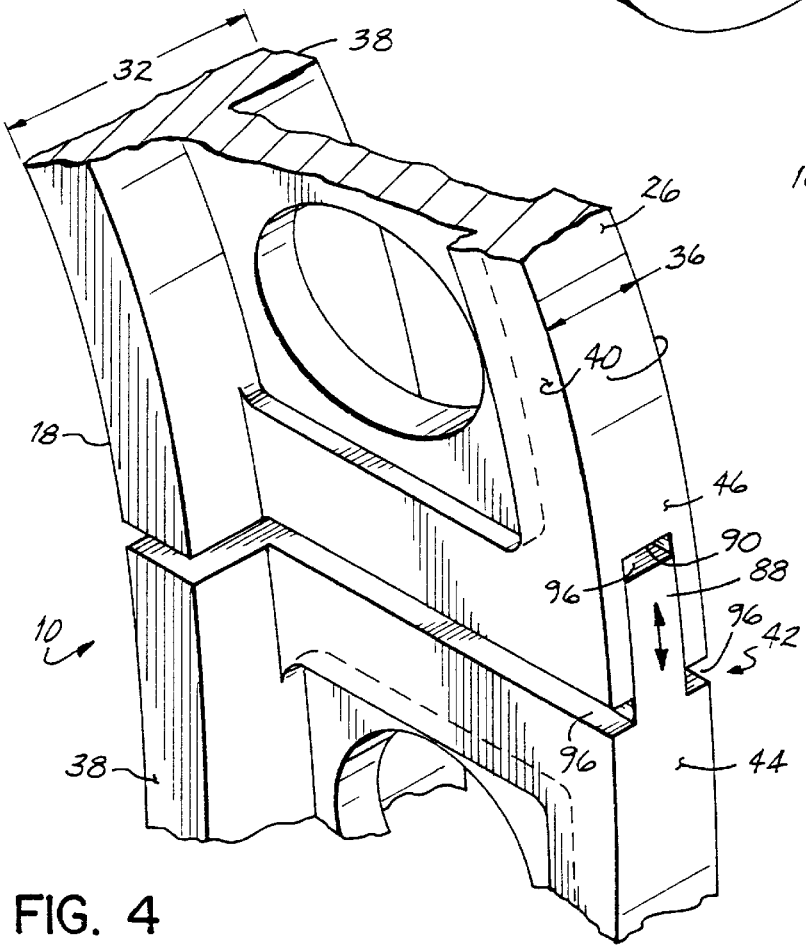
FIG. 4 is an enlarged perspective view of encircled area 4 of FIG. 2, detailing one embodiment of the joint configuration for expanding the core of the present invention.
Figure 5:
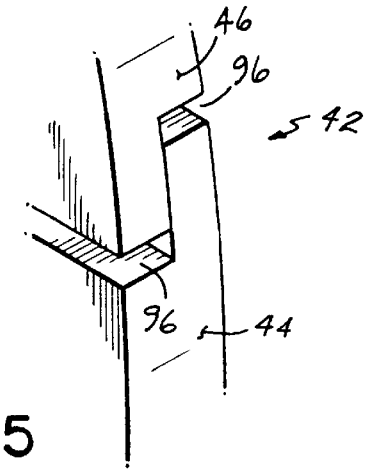
Figure 6:
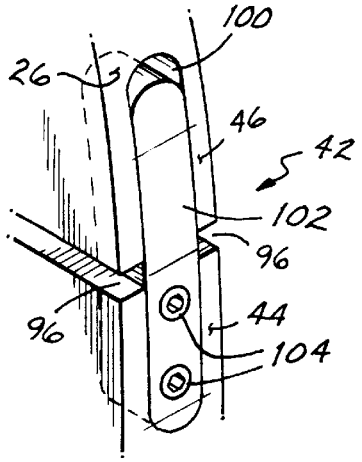

FIG. 5. is a view similar to FIG. 4 showing an alternative embodiment of the joint configuration; and FIG. 6. is another view similar to FIG. 4 showing yet another alternative embodiment of the joint configuration.

DETAILED DESCRIPTION

Figure 1:
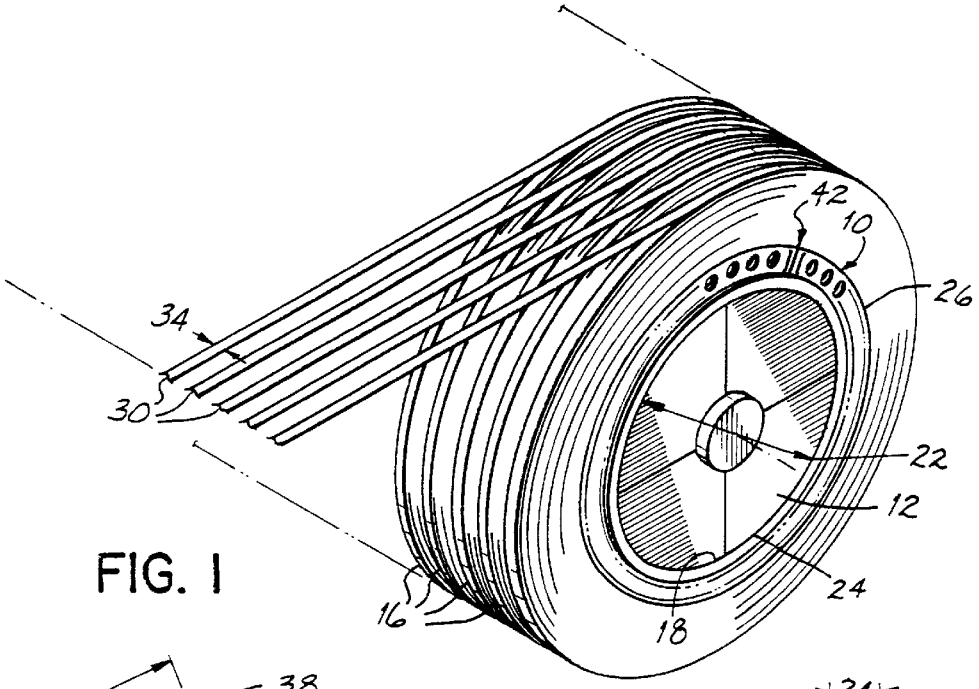
FIG. 1 is a perspective view of the recoiler showing the slit material being wound upon the mandrel and the core of the present invention.

As shown in FIG. 1, the present invention relates to the recoiler portion 14 (partially shown) of a slitting machine (not shown). With prior systems, the outer diameter 22 of the expandable mandrel 12 established the inner diameter of the rewound coil 16, for example. Thus, as discussed earlier, the inner diameters of the rewound coils were limited to the standard diameters of commercially available mandrels. The present invention overcomes that limitation by mounting an annular core 10 over the mandrel 12. Thus, the material from the slitting machine is wound onto the core 10 to generate a coil of slit metal 16 having an inside diameter of some dimension other than that of a standard expandable mandrel 12.

Figure 2:
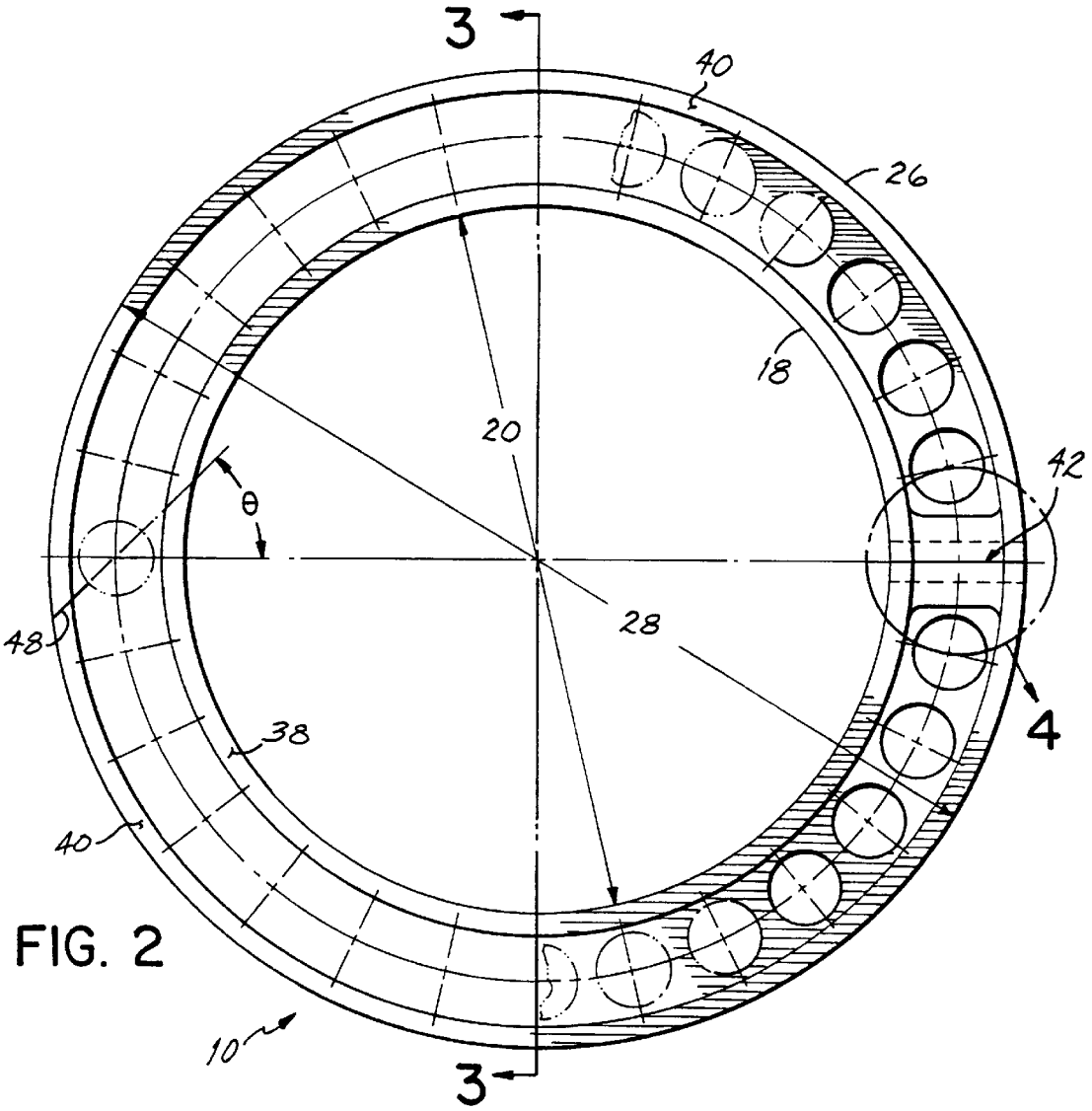
FIG. 2 is a side view of an expandable core of the present invention.

Referring to FIG. 2, the inner surface 18 of the expandable core 10 has a diameter 20 that is approximately equal to the diameter 22 of the outer surface 24 of the expandable mandrel 12. The outer surface 26 of the core 10 has a diameter 28 that corresponds to the desired inner diameter of the coiled slit metal 16. For example, to obtain a coil of slit metal 16 with a 32 inch inner diameter for a particular application, a conventional expandable mandrel 12 with a 24 inch diameter 22 may be used with a core 10 having about a 24 inch inner diameter 20 and a 32 inch outer diameter 28. This alleviates the need to manufacture a new 32 inch mandrel.

As shown in FIG. 1, the expandable cores 10 are coaxially positioned side-by-side on the expandable mandrel 12 so as to accommodate the plurality of strands 30 created by the slitter (not shown). The cores 10 are preferably positioned such that each core 10 receives a single strand 30 of slit metal. When mounting the cores, the mandrel is in its collapsed or retracted state and, as will subsequently be described in detail, the core 10 is split in the axial and radial directions so that the core can expand with the mandrel.

While the mandrel 12 and cores 10 are in the expanded position, the strands 30 are wound onto the cores 10. Upon completion of the slitting and rewinding process the mandrel 12 is subsequently retracted and the diameter of the cores 10 are simultaneously reduced, thus enabling the coils 16 to be easily slid off the mandrel and core assembly of the recoiler 14.

Figure 3:
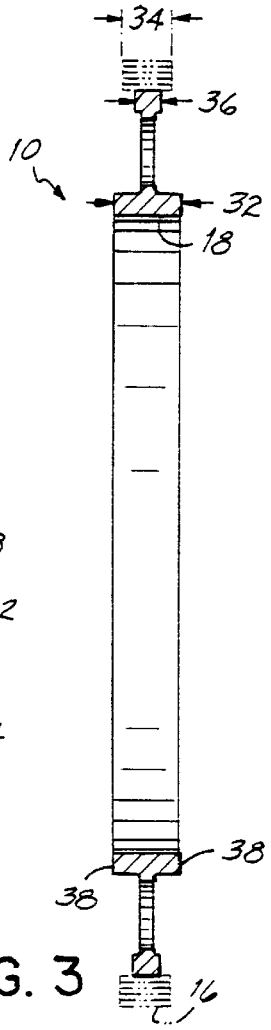
FIG. 3 is a cross-sectional view taken along line 3—3 of FIG. 2.

Referring to FIGS. 3 and 4, the width 32 of the core 10 at the inner surface 18 is preferably equal to or greater than the width 34 of the strands 30 of slit metal, and the width 36 of the core 10 at the outer surface 26 is preferably equal to or less than the width 34 of the strands 30 of the slit metal. In a preferred embodiment of the present invention shown in FIG. 3, the width 32 at the inner surface 18 of the core 10 is greater than the width 36 at the outer surface 26 of the core 10 and greater than the width 34 of the strands 30 of slit metal. In this preferred embodiment, the cores 10 are placed side by side in series so that the cores 10 touch at the sides 38 adjacent the inner surface 18, but are spaced apart at the sides 40 adjacent the outer surface 26, so that the individual strands 30 do not contact each other during recoiling. Spacers (not shown) may be added between the individual strands 30 to maintain the separation, if desired. This would be particularly desirable where the widths 32, 36 at the inner and outer surfaces 18, 26 of the coil are equal or where the slit width 34 is greater than the width 36 at the outer surface 26.

To enable the core 10 to be expanded and contracted along with the mandrel 12, there is a radial expansion slot or joint 42 in the core 10, such as that shown in FIGS. 2 and 4. In the embodiments best shown in FIGS. 4 and 5, the joint 42 has opposing ends 44, 46 that are slidably interconnected. For instance, the structure of radial expansion joint 42 of FIG. 4 is comprised of a tongue 88 on end 44 and a groove 90 on end 46. In the contracted position, the opposing ends 44, 46 are fully interconnected. In the expanded position, the opposing ends 44, 46 slide apart in the circumferential direction, but remain partially interconnected so as to form blind axial gaps 96 in the width of the core 10. A blind axial gap, as referred to herein, is a gap in the axial direction that does not extend through the entire width of the core 10. In other words, no gap extends all the way through the core in a single axial plane. Such a configuration best allows the coil 16 to maintain its circular configuration because there is no complete break of continuity in the periphery or outer surface 26 of the core 10. If a complete break of continuity in the outer surface 26 exists, there is a potential for the slit metal to be drawn into the gap.

Alternatively, the radial expansion slot or joint may be structured such that an axial and radial cut is placed through the entire width of the core. A groove or keyway 100 is formed in the outer surface 26 of ends 44, 46. The keyway 100 need only be of limited depth, such as ½ inch. A key 102 is then placed in the keyway 100 and secured to one of the ends 44, 46, such as by screws 104. Thus, the key 102 bridges any gap that may occur between the ends 44, 46 upon expansion of the core 10 and the mandrel 12. Further, blind axial gaps 96 are formed on either sides of the key 102 upon expansion of the core 10 and mandrel 12. The key thus prevents a complete break of continuity in the outer surface 26 of the core 10.

It should be appreciated that other configurations, for example, as shown in FIG. 5, also provide for an enlargement of the diameter and circumference of the core 10 by separation of opposing ends 44, 46 of the core 10 to form blind axial gaps 96.

In any embodiment, the radial expansion slot or joint 42 may be created by a conventional wire EDM (Electrical Discharge Machining) process or any other suitable process.

By way of example, to produce a plurality of coils 16 (FIG. 1) having a 1 inch width and a 32 inch inner diameter from a 48 inch wide metal sheet, a slitting machine is used with a slitter having a slit width of 1 inch for cutting the sheet into 48 individual strands 30 and a recoiler having a 24 inch expandable mandrel 12 (23 5/16 inches in the retracted position). The expandable mandrel 12 is retracted, and 48 expandable annular cores 10 having about a 24 inch expanded inner diameter 20 (about 23 5/16 inches in the retracted position) and a 32 inch expanded outer diameter 28 are mounted in their retracted/relaxed position in series on the mandrel 12. The cores 10 have a width 32 at the inner surface 18 of 2 inches and a width 36 at the outer surface 26 of 1 inch. The mandrel 12 is expanded to its 24 inch diameter, typically be means of a hydraulic cylinder, which simultaneously expands the cores 10 to create up to about a ½ inch expansion in the outer circumference of the cores 10 and approximately a 16/100 inch increase in the outer diameter 28. Each 1 inch wide strand 30 is wound onto the 1 inch wide outer surface 26 of a corresponding core 10, with a 1 inch space between coils 16 resulting from the greater width 32 at the inner surface 18 of each core 10. Upon completion of the recoiling, the mandrel 12 is retracted and the cores 10 collapse automatically with the mandrel 12. The individual coils 16 can then be removed easily from the mandrel 12 and cores 10. The core is made from a sufficiently ductile material capable of allowing the core to expand and relax in response to expansion and contraction of the mandrel.

In a further feature of the present invention, a second slot 48 is provided in each core 10 for inserting the end of the strand 30 to secure the strand 30 to the core 10 in the beginning of the recoiling process. The strand 30 is inserted into the slot 48 when the core is in its relaxed position, and upon expansion of the mandrel 12 and core 10, the slot 48 clamps down on the strand 30, securing it in place. After recoiling, the mandrel 12 and core 10 are collapsed and the end of the strand 30 is released. This slot 48 may again be formed by a wire EDM process or any other suitable process. The width of the slot 48 may vary according to the thickness of the sheet metal, but typically a width of about 0.025 inch will be suitable. In a preferred embodiment of the present invention, the second slot 48 is opposite the radial expansion slot or joint 42 and at an angle $\theta$ of about 45°.

As previously stated, the annular cores may be made from materials that are sufficiently ductile to withstand the expansion and contraction without fracture and that are sufficiently strong to withstand the weight of the coils. It is also desirable to select materials that are inexpensive such that a large number of cores may be manufactured at a cost sufficiently less than the cost of manufacturing a new mandrel. The material selected is also preferably lightweight to facilitate manual placement on the mandrel. In a preferred embodiment of the present invention, aluminum (ALMAG (535 T-2)) cores are manufactured using sand or permanent mold castings.

The embodiments of the present invention described above provide an inexpensive means for a sheet metal slitter to adjust the size of the inner diameter of the rewound coils to meet the demands of customers. The expandable annular cores of the present invention may be used with the standard diameter mandrels already in widespread use, so that non-standard diameter mandrels need not be manufactured to meet customer needs. This is particularly useful for low quantity, special orders where the high cost of manufacturing a special mandrel would be cost prohibitive.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, a single annular core may be used to wind two or more strands side by side or one on top of another. Furthermore, the dimensions of the cores may vary without departing from the scope of the invention. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A recoiler for use in a coil slitting machine, said recoiler comprising:

a diametrically expandable mandrel; and at least one diametrically expandable annular core mounted on the mandrel, the core comprising a first opposing end having a tongue and a second opposing end having a groove, the first opposing end movable with respect to the second opposing end to diametrically expand and contract the annular core, and the core expandable with no substantial gap in a radially outer surface thereof extending fully across an axial width of the core, and the core adapted to receive a strip of slit metal.

2. The recoiler of claim 1, wherein the first opposing end slidably interconnects with the second opposing end, and the first opposing end remains partially interconnected with the second opposing end upon expansion of the core.

3. A recoiler for use in a coil slitting machine, said recoiler comprising:

a diametrically expandable mandrel; and at least one annular core mounted on the mandrel and adapted to receive a strip of slit metal, the core comprised of a radially outer surface and a first opposing end slidably interconnected with a second opposing end for diametrically expanding the core with no substantial gap in the outer surface of the core extending fully across an axial width of the core.

4. The recoiler of claim 3, wherein the first opposing end includes a tongue and the second opposing end includes a groove.

5. The recoiler of claim 3, wherein the first opposing end remains partially interconnected with the second opposing end upon expansion of the core.

6. The recoiler of claim 3, wherein the first opposing end and the second opposing end each have an opposing keyway formed in the outer surface of the annular body, and a key is disposed in the opposing keyways, the key being secured to one of the first and second ends.

7. A method of winding a plurality of strands of slit metal material, comprising the steps of:

placing a plurality of diametrically expandable annular core members in series on a diametrically expandable mandrel, wherein the core members each have a radially outer surface for receiving a strand of slit metal material and a radial joint with a first opposing end slidably interconnected with a second opposing end for expanding the core member;

diametrically expanding the mandrel and core members wherein each of said core members expand with no substantial gap in the outer surface of the core member extending fully across an axial width of the core member;

rotating the mandrel so as to wind each strand around the outer surface of a corresponding core member to form a plurality of coils;

contracting the mandrel and core members; and removing the coils from the mandrel and core members.

8. The method of claim 7, wherein the first opposing end includes a tongue and the second opposing end includes a groove.

9. The method of claim 7, wherein the first opposing end remains partially interconnected with the second opposing end upon expansion of the core member.

* * * * *